US011111707B1

(12) United States Patent
Balli

(10) Patent No.: US 11,111,707 B1
(45) Date of Patent: Sep. 7, 2021

(54) DOOR BARRICADE SYSTEM

(71) Applicant: Perry Mason Balli, Slidell, LA (US)

(72) Inventor: Perry Mason Balli, Slidell, LA (US)

( * ) Notice: Subject to any disclaimer, the term of this patent is extended or adjusted under 35 U.S.C. 154(b) by 516 days.

(21) Appl. No.: 16/105,074

(22) Filed: Aug. 20, 2018

(51) Int. Cl.
*E05C 19/18* (2006.01)

(52) U.S. Cl.
CPC ..... *E05C 19/188* (2013.01)

(58) Field of Classification Search
CPC ..... E05C 17/00; E05C 17/02; E05C 17/44; E05C 17/46; E05C 17/48; E05C 17/54; E05C 19/003; E05C 19/18; E05C 19/184; E05C 19/188; Y10T 292/34; Y10T 292/37; Y10T 292/379; Y10T 292/388; Y10T 292/65; Y10T 292/67; Y10T 16/61; Y10T 16/615; Y10S 292/15; Y10S 292/19; Y10S 292/37; Y10S 292/65; Y10S 292/67
USPC ..... 16/82
See application file for complete search history.

(56) References Cited

U.S. PATENT DOCUMENTS 1,082,432 A * 12/1913 Mertsheimer ..... E05B 5/003 292/1
5,199,759 A 4/1993 Anderson
5,398,982 A * 3/1995 Watson, Jr. ..... E05C 3/048 292/259 R
5,454,143 A * 10/1995 Wigley, Sr. ..... E05B 65/0894 16/82
5,454,610 A 10/1995 Taylor et al.
5,490,304 A * 2/1996 Winner, Jr. ..... E05F 5/06 16/82
5,890,751 A 4/1999 Seffinga
6,378,917 B1 * 4/2002 Jones ..... E05C 19/184 16/82
6,557,912 B1 * 5/2003 Truong ..... E05C 17/50 292/338
7,014,229 B1 * 3/2006 Stelmach ..... E05C 17/44 292/342
7,651,140 B2 * 1/2010 Leggio ..... E05C 1/04 292/288
8,925,359 B2 1/2015 Frankel
9,518,421 B2 12/2016 Cushwa, Jr. et al.
2006/0043739 A1 * 3/2006 Gogel ..... E05C 19/184 292/148
2007/0040394 A1 * 2/2007 Weselak ..... E05C 19/184 292/292

(Continued)

FOREIGN PATENT DOCUMENTS

GB 2532716 * 6/2016 ..... E05C 17/54

*Primary Examiner* — Kristina R Fulton
*Assistant Examiner* — Steven A Tullia
(74) *Attorney, Agent, or Firm* — George L Williamson

(57) ABSTRACT

Method and apparatus for a safety door barricade for use with a door of a school room or the like. It is made of a single piece of angle iron having a base portion and a back portion disposed 90 degrees apart with a curved handle extending from the surface of the base portion to the back portion along with a downwardly extending rod which is designed for insertion into a hole disposed in the surface of the floor adjacent the door just inside the door. When the device is in inserted in its safety barricade position, and the door is opened against the back plate of the device, a barricade is provided. When the device is not in its safety barricade position, it is placed into an adjacent hole in the floor next to the door wherein the safety device can be stored in an unobtrusive location.

12 Claims, 2 Drawing Sheets

(56) References Cited

U.S. PATENT DOCUMENTS

| | | | | |
|---|---|---|---|---|
| 2011/0291426 | A1* | 12/2011 | Gibson | E05C 19/003 292/137 |
| 2012/0274081 | A1* | 11/2012 | Frazier | E05B 65/0007 292/137 |
| 2014/0306466 | A1* | 10/2014 | Couturier | E05C 19/184 292/338 |
| 2017/0211301 | A1 | 7/2017 | Richmond | |

* cited by examiner

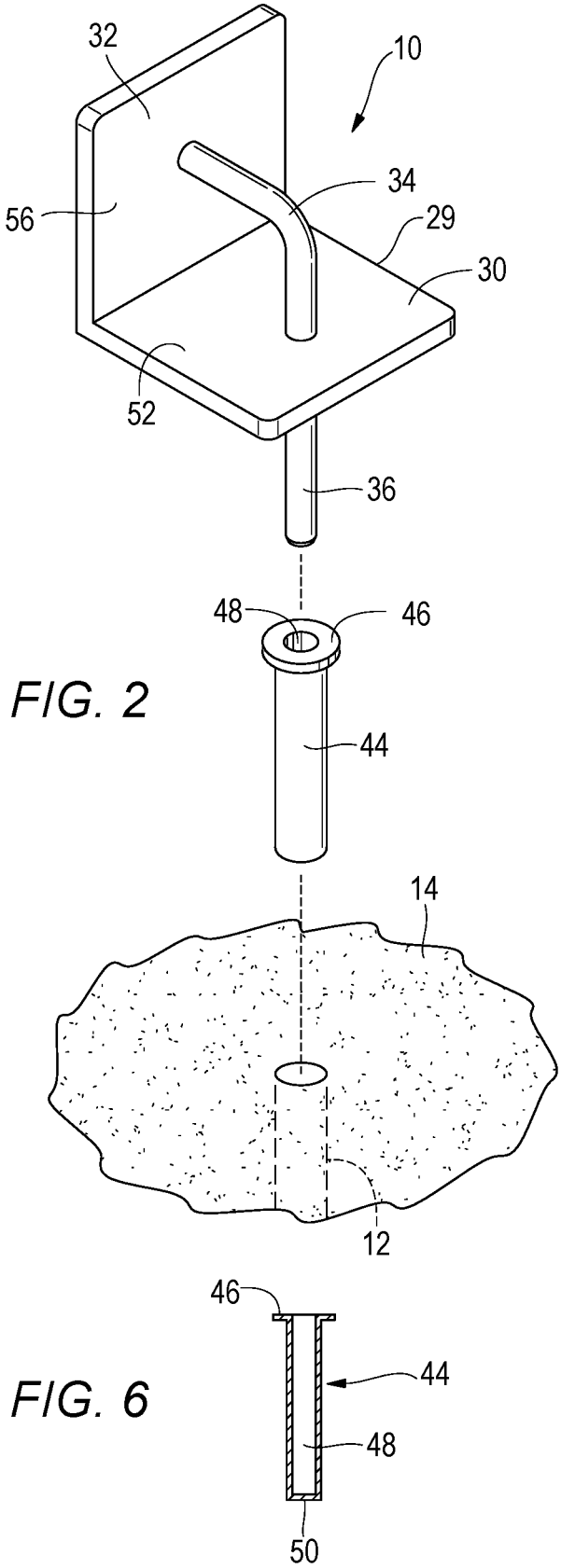
FIG. 2
FIG. 6
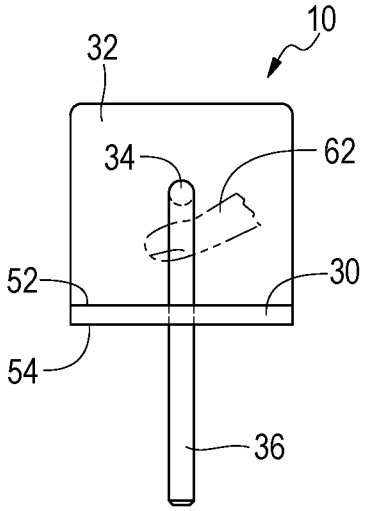
FIG. 3
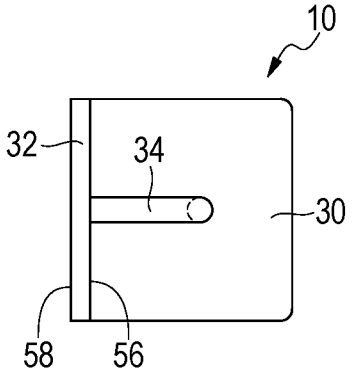
FIG. 4
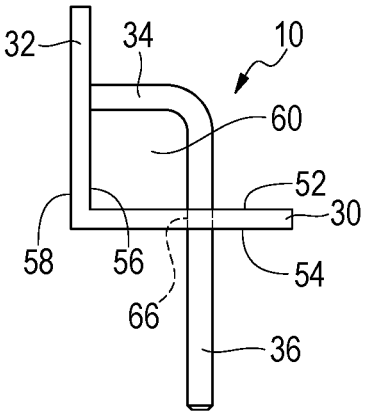
FIG. 5

DOOR BARRICADE SYSTEM

BACKGROUND OF THE INVENTION

Field of the Invention

The present invention relates generally to door barricades and door safety devices and, more particularly, is concerned with a door barricade system.

Description of the Related Art

Devices relevant to the present invention have been described in the related art, however, none of the related art devices disclose the unique features of the present invention.

In U.S. Pat. No. 5,199,759 dated Apr. 6, 1993, Anderson disclosed a front mounted door lock. In U.S. Pat. No. 5,454,610 dated Oct. 3, 1995, Taylor, et al., disclosed a door security device. In U.S. Pat. No. 5,890,751 dated Apr. 6, 1999, Seffinga disclosed a floor mounted door lock. In U.S. Pat. No. 8,925,359 dated Jan. 6, 2015, Frankel disclosed a security door brace system and method of use thereof. In U.S. Pat. No. 9,518,421 dated Dec. 13, 2016, Cushwa, Jr., et al., disclosed a safety door barricade. In U.S. Patent Application Publication No. 2017/0211301 dated Jul. 27, 2017, Richmond disclosed a door barricade.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a safety door barricade for use with a door of a school room or the like. It is made of a single piece of angle iron having a base portion and a back portion disposed 90 degrees apart with a curved handle extending from the surface of the base portion to the back portion along with a downwardly extending rod which is designed for insertion into a hole disposed in the surface of the floor adjacent the door just inside the door. When the device is in inserted in its safety barricade position, and the door is opened against the back plate of the device, a barricade is provided. When the device is not in its safety barricade position, it is placed into an adjacent hole in the floor next to the door wherein the safety device can be stored in an unobtrusive location.

An object of the present invention is to provide a safety door barricade for use on a door to prevent the unauthorized opening of the door. A further object of the present invention is to provide a safety door barricade which can be easily used by an operator. A further object of the present invention is to provide a safety door barricade which can be easily and inexpensively manufactured.

A further object of the present invention is to provide a system for barricading the door of a school room in order to protect the occupants on the inside of a school room. A further object of the present invention is to provide a safety door barricade which can reduce the chance of a school terrorist from entering into a school room in order to commit crimes.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 2 is an exploded perspective view of the present invention.

FIG. 3 is a front view of the present invention.

FIG. 4 is a top view of the present invention.

FIG. 5 is an inside view of the present invention.

FIG. 6 is a cross sectional view of the receptacle of the present invention.

LIST OF REFERENCE NUMERALS

Figure 1:
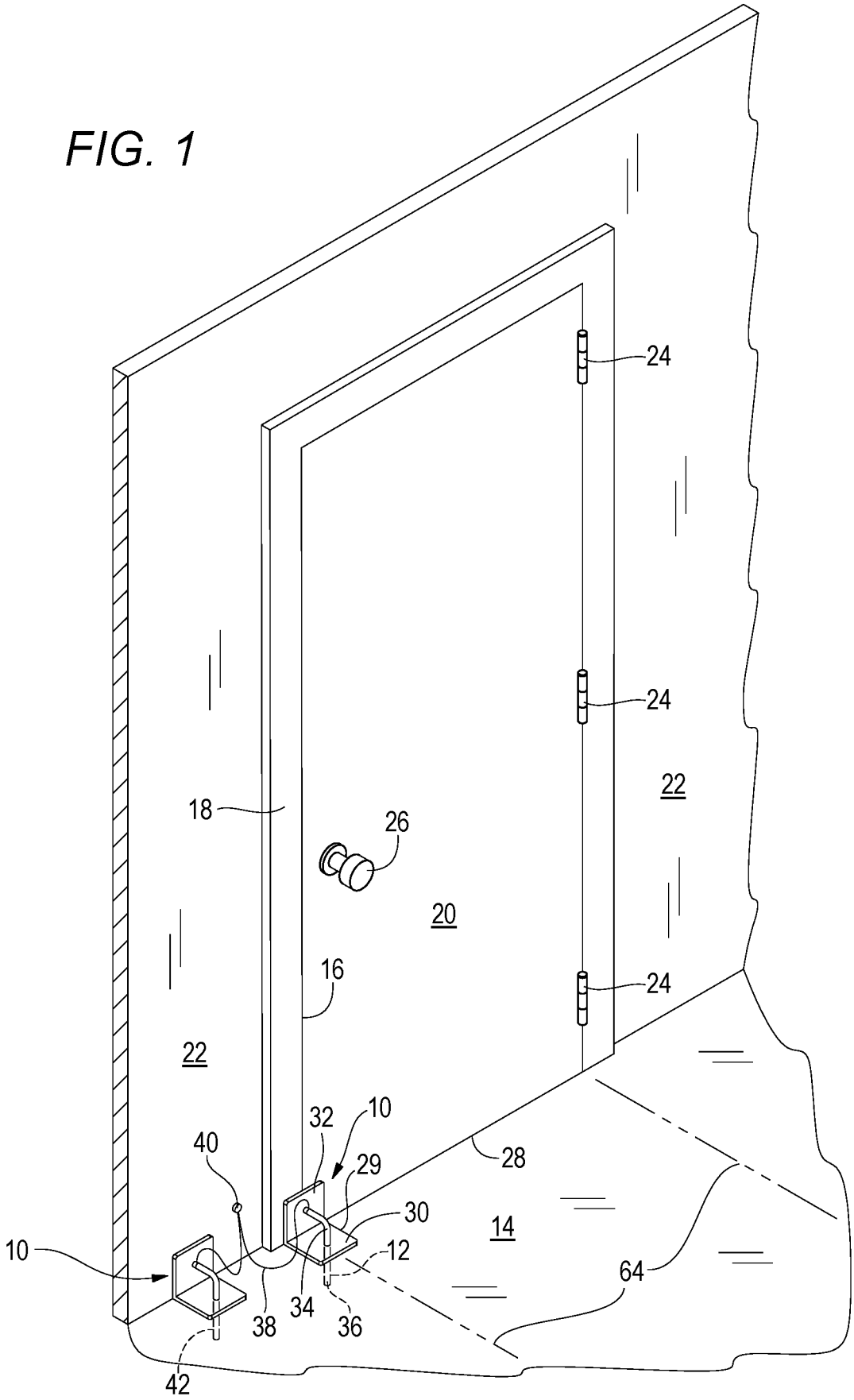
FIG. 1 is a perspective view of the present invention shown in operative connection.

With regard to reference numerals used, the following numbering is used throughout the drawings.

10 present invention
12 first hole in floor
14 floor
16 space/gap
18 door frame
20 door
22 wall
24 hinge
26 door knob
28 bottom of door
29 angle iron
30 base portion
32 back portion
34 pull handle
36 spike/rod
38 tether
40 connector
42 second hole
44 receptacle
46 rim
48 aperture
50 bottom of receptacle
52 top surface
54 bottom surface
56 front surface
58 rear surface
60 space
62 finger
64 entryway of the door
66 aperture

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a safety door barricade for a school room door is disclosed and which is generally indicated by reference number 10.

Turning to FIG. 1, therein is shown the present invention 10 placed into a hole 12 of the floor 14 of a school room, or the like, so that it is aligned with the space or gap 16 between the inner edge of the door frame or jamb 18 and the corresponding edge of the door 20 wherein the door is mounted onto the wall 22 in the conventional manner using a plurality of hinges 24 along with having a conventional door knob 26. The door 20 is hung to swing inwardly so that its bottom edge passes over a path overlying hole 12. Therefore, when the door is opened the present invention 10 which is anchored and interlocked with the floor 14 acts as a barricade by engaging against the bottom 28 of the door 20. The present invention 10 is made of a piece of angle iron 29 or the like having a horizontal base portion 30 and a vertical back portion 32 disposed perpendicular to each other and having a pull handle 34 being curved to extend between the base portion 30 and back portion 32 of the present invention 10 so that a user can grasp the handle 34 of the present invention in order to remove the present invention from the hole 12 or replace it in the hole. The present invention 10 has a spike or rod 36 extending downwardly from the bottom surface of the base 30 thereof for easy insertion and removal from the hole 12. The present invention 10 is attached to the wall 22 using a tether 38 extending from the present invention 10 to a connector 40 securely disposed on the wall 22. When not in use, the present invention 10 is disposed in a second hole 42 placed in the concrete floor 14 proximate the first hole 12 so that the present invention 10 can be stored in an out of the way location so as to not to interfere with traffic passing through the door 14 and the entryway 64 of the door.

Turning to FIG. 2, therein is shown the present invention 10 showing the angle iron 29 along with the base 30, the back 32, handle 34 and downwardly extending spike 36 which passes through a receptacle 44 for insertion into the hole 12 of the concrete floor wherein the receptacle 44 forms a receiver having a rim 46 around its upper end for stopping and fitting against the upper surface of the hole 12 in the floor so that the receptacle can be easily retrieved from the hole 12. Also shown is a central aperture 48 in the receptacle 44 for receiving the spike 36 from the bottom of the base 30 of the present invention 10.

Turning to FIGS. 3 through 5, therein are shown various traditional views of the present invention 10 showing the elements of the present invention as previously disclosed. FIG. 3 shows finger 62 of a hand of a user in place to lift the pull handle 34 of the present invention 10 by passing through space 60 between the handle and the back portion 32.

Turning to FIG. 6, therein is shown a cross sectional view of the receptacle 44 showing its rim 46 along with its aperture 48 and a bottom 50 of the receptacle which prevents the hole 12 from filling up with dirt so that the receptacle 44 can be removed and cleaned on an as needed basis.

The present invention 10 is designed to barricade a door 20 and keep it from opening when necessary to prevent unauthorized opening and is fabricated from a metal angle bracket 29 with a bent metal round bar welded to it to form a handle 34. The bent section of the round bar is used as a pull handle 34 and the lower part of the round bar projects through an aperture 66 out of the bottom of the angle bracket to form a spike or rod 36. Rod 36 is welded only to the back 32 of angle iron 29 leaving it free to flex slightly at its passageway through aperture 66 if the door 20 is pushed on very hard so that great force is applied from its outside toward its inside. The lower portion 36 of the round bar is designed to insert into a pre-drilled hole 12 in the floor 14 in front of a door 20. When the round bar 36 is inserted into the hole 12 with the flat side of the angle bracket against the door 20 the device 10 will prevent the door from opening. Accordingly, the door 20 is effectively prevented from opening at all or past a predetermined point which point is determined by the positioning of the hole 12 in the floor 14 with respect to the door so long as the door and its hinges 24 do not fail. The present invention 10 can be stored in a second unobtrusive hole 42 adjacent the door frame and then deployed as shown in FIG. 1.

By way of additional summary and by making reference to FIGS. 1-6, the present invention 10 provides a method of assembling a barricade for a door 20 including providing a construction having a base portion 30 and a back portion 32, the base portion having top 52 and bottom 54 surfaces, the back portion having front 56 and rear 58 surfaces, the base portion and the back portion being perpendicular to each other; forming a handle 34 from a bar extending between the top surface of the base portion and the front surface of the back portion, wherein the bar is curved; forming a spike 36 extending perpendicularly away from the bottom surface for insertion into a first hole 12 in a concrete floor 14 adjacent the door so that the bottom surface rests on the concrete floor; and, wherein when the spike is inserted into the hole the rear surface contacts an inner surface of a bottom 28 of the door so as to form a barricade against the door to prevent unauthorized opening of the door. Further, including forming the base portion and the back portion from a continuous one piece structure of material 29 so that they have a flat, rectangular shape and forming the handle or bar 34 and the spike 36 from a continuous one piece structure of material so that they are round in shape, wherein the handle formed by the bar or handle is sized and shaped to provide a space 60 between the bar and the top and front surfaces, wherein the space is sized and shaped to receive a finger 62 of a hand of a user and including a tether 38 for connecting the construction to a surface of a wall 22 adjacent the door for securing the construction to the wall, wherein the construction has a deployed position when the spike is inserted into the first hole and a stored position when the spike is inserted into a second hole 42 in the concrete floor adjacent the door and outside an entryway 64 of the door.

I claim:

1. A barricade for a door, comprising:

a) a construction comprising an angle iron having a horizontal base portion and a vertical back portion, said base portion having top and bottom surfaces, said back portion having front and rear surfaces, said base portion and said back portion being perpendicular to each other;

b) a handle comprising a bar extending between said top surface and said front surface, a proximal end of said bar being fixedly attached to said front surface of said back portion wherein said bar is curved and spaced along a portion of its length a sufficient distance away from said top and front surfaces to allow grasping by a user;

c) a distal part of said bar projecting through an aperture in said base portion forming a spike extending perpendicularly away from said bottom surface adapted for insertion into a first hole in a concrete floor adjacent the door so that said bottom surface rests on said concrete floor;

d) said barricade having a deployed position with said spike extending into said first hole and said rear surface in contact with an inner surface of a bottom portion of the door thereby preventing unauthorized opening of the door, said angle iron being free to flex when said door is pushed; and e) said barricade having a standby position when not deployed comprising a second hole in said concrete floor away from said door allowing said door to oven whereby said barricade is adapted to be readily moved between said first and second holes by said user lifting said constructing using said handle.

2. The barricade of claim 1, wherein said base portion and said back portion are flat, rectangular members formed from a continuous one piece structure of material.

3. The barricade of claim 1, wherein said bar and said spike are round members formed from a continuous one piece structure of material.

4. The barricade of claim 1, wherein the handle formed by said bar is sized and shaped to provide a space between said bar and said top and front surfaces, wherein said space is sized and shaped to receive a finger of a hand of said user.

5. The barricade of claim 4, further comprising a tether for connecting said construction to a surface of a wall adjacent the door for securing said construction to said wall.

6. The barricade of claim 5, wherein said deployed position of said construction is located so that said vertical back portion overlaps a portion of a door frame adjacent an edge of said door.

7. A method of assembling and using a barricade for a door, comprising the steps of:

a) providing a construction comprising an angle iron having a base portion and a back portion, the base portion having top and bottom surfaces, the back portion having front and rear surfaces, the base portion and the back portion being perpendicular to each other;

b) forming a handle from a bar extending between the top surface of the base portion and the front surface of the back portion, wherein the bar is curved and spaced along a portion of its length a sufficient distance away from said top and front surfaces to allow grasping by a user, a proximal end of said bar being fixedly attached to said front surface;

c) forming a distal part of said bar projecting through an aperture in said top surface into a spike extending perpendicularly away from the bottom surface for insertion into a first hole in a concrete floor adjacent the door so that the bottom surface rests on the concrete floor;

d) said user deploying said apparatus by lifting said construction by said handle and inserting the spike into the first hole with the rear surface in contact with an inner surface of a bottom portion of the door so as to form a barricade against the door to prevent unauthorized opening of the door, said angle iron being free to flex when said door is pushed; and e) said user lifting said construction with a finger or hand, raising said spike out of said first hole and moving said construction to a standby, non-deployed position in which said spike is inserted into a second hole in said concrete away from said door allowing said door to open, whereby said barricade is readily moved between said first and second holes by said user lifting said apparatus using said handle.

8. The method of claim 7, further comprising the step of forming the base portion and the back portion from a continuous one piece structure of material so that they have a flat, rectangular shape being perpendicular to each other.

9. The method of claim 7, further comprising the step of forming the bar and the spike from a continuous one piece structure of material so that they are round in shape.

10. The method of claim 9, wherein the handle formed by the bar is sized and shaped to provide a space between the bar and the top and front surfaces, wherein the space is sized and shaped to receive a finger of a hand of said user.

11. The method of claim 10, further comprising the step of providing a tether for connecting the construction to a surface of a wall adjacent the door for securing the construction to the wall.

12. The method of claim 11, wherein said deployed position of said construction is located so that said vertical back portion overlaps a portion of a door frame adjacent an edge of said door.

* * * * *